United States Patent [19]

Polzer

[11] Patent Number: 4,630,044

[45] Date of Patent: Dec. 16, 1986

[54] PROGRAMMABLE INDUCTIVELY COUPLED TRANSPONDER

[75] Inventor: Rudolf Polzer, Backnang, Fed. Rep. of Germany

[73] Assignee: ANT Nachrichtentechnik GmbH, Backnang, Fed. Rep. of Germany

[21] Appl. No.: 563,745

[22] Filed: Dec. 21, 1983

[30] Foreign Application Priority Data

Dec. 23, 1982 [EP] European Pat. Off. ..... 82111965.8

[51] Int. Cl.[4] ..... H04Q 9/14; H04Q 7/00

[52] U.S. Cl. ..... 340/825.72; 340/825.54; 340/941; 367/297

[58] Field of Search ..... 340/825.72, 696, 825.54, 340/941; 367/197; 455/41; 343/6.5 SS, 6.8 R

[56] References Cited

U.S. PATENT DOCUMENTS

| | | | |
|---|---|---|---|
| 4,333,072 | 6/1982 | Beigel | 340/825.54 |
| 4,364,043 | 12/1982 | Cole et al. | 340/825.54 |
| 4,388,524 | 6/1983 | Walton | 340/825.72 |
| 4,459,590 | 7/1984 | Saulnier | 340/825.54 |
| 4,550,444 | 10/1985 | Uebel | 340/825.54 |

FOREIGN PATENT DOCUMENTS 2846129 12/1980 Fed. Rep. of Germany .

OTHER PUBLICATIONS

"Keeping Current News and Trends", *Automation*, Jan. 1975, p. 12.

"Self-Powered Chip Identifies Railcars", *Electronics International*, Mar. 1982, p. 40, vol. 55.

Palatnick, "Automatic Vehicle Identification Systems-Methods of Approach", IEEE Transactions on Vehicular Technology, vol. VT 19, No. 1, Feb. 1970, pp. 128-136.

*Primary Examiner*—Donald J. Yusko

*Attorney, Agent, or Firm*—Spencer & Frank

[57] ABSTRACT

An automatic information transmission system for a mobile object, the system including a response unit arranged to be carried along with the mobile object, and an interrogation unit arranged to be disposed alongside the path of movement of the mobile object for movement of the response unit past the interrogation unit. The interrogation unit is arranged to emit a carrier signal at a first frequency and to receive a signal at a second frequency different from the first frequency. The response unit includes a memory for storing information relating to the mobile object, a signal generator connected to the memory for generating a signal at the second frequency and containing the stored information, a signal receiver for receiving the carrier signal at the first frequency emitted by the interrogation unit, an emitter connected to the signal generator for emitting the signal generated thereby, and an energy converter connected between the signal receiver and signal generator for deriving operating power for the generator from the carrier signal at the first frequency.

15 Claims, 7 Drawing Figures

MODULATOR
M1
m
AF
OSCILLATOR
O1
DEMODULATOR
DM
L2
L1
C
f1
f2
AW
VS
K
D
OSCILLATOR
O2
M
MODULATOR
Cs
MEMORY
S
DM1
DEMODULATOR

MEMORY
S
OPTO-ELECTRICAL TRANSDUCER
OET
OPTICAL TRANSMITTER
OT

MEMORY
S
ULTRASOUND-ELECTRICAL TRANSDUCER
UET
ULTRASOUND TRANSMITTER
UT

MEMORY
S
RC
RECEIVER
A2
A1
RF-TRANSMITTER
TR
L

PROGRAMMABLE INDUCTIVELY COUPLED TRANSPONDER

BACKGROUND OF THE INVENTION

The present invention relates to an automatic information exchange system for mobile objects, which system includes response units which are arranged at the mobile objects and each of which contains stored information regarding the associated object, and at least one interrogation unit which, when passing by a response unit, transmits a carrier signal of a first frequency to the respective response unit so as to supply operating power to the circuit elements of the response unit to enable the response unit to emit a signal modulated with the stored information at a second frequency for reception by the interrogation unit.

Such an information system equipped with interrogation and response units is disclosed in IEEE Transactions on Vehicular Technology, VOL. VT-19, No. 1, February 1970, pp. 128–136. Herein is not described a practical realization of the antennas of the response unit with which the response unit receives the carrier signal from the interrogation unit and transmits the response signal to the interrogation unit.

A response unit of an information system disclosed in German Pat. No. 2, 846,129 has a ferrite rod antenna to receive the carrier signal transmitted by an interrogation unit. However, the response unit also has a second antenna for transmitting a response signal to the interrogation unit, such signal being a signal modulated with the information stored in the response unit at another frequency than the frequency of the received carrier signal. Equipping the response units with two different antennas results in a large-area and bulky structure for the response units.

SUMMARY OF THE INVENTION

It is an object of the present invention to provide response units for such an automatic system which are compact and easy to handle so as to permit flexible use with the most varied types of mobile objects.

This is accomplished according to the present invention in that the response unit has a transmitting/receiving antenna consisting of a single induction coil and forming part of both signal receiving means and emitting means of said response unit, said signal receiving means comprises a first resonant circuit tuned to the first frequency and including at least part of said coil, and said emitting means of said response unit comprises a second resonant circuit tuned to the second frequency and including at least part of said coil.

Suitable embodiments and uses of the invention will become evident from the following description.

The response unit according to the present invention can be designed in a very handy form because no independent energy source and only a single antenna in the form of an induction coil are required to receive the signal furnishing the operating voltage and to transmit an information signal to an interrogation unit.

BRIEF DESCRIPTION OF THE DRAWING

The invention will now be explained in greater detail with reference to an embodiment which is illustrated in the drawing.

DESCRIPTION OF THE PREFERRED EMBODIMENTS

The automatic information system described above can be used to identify mobile objects, such as, for example, rail bound vehicles or merchandise or the like moving on conveyor belts. The information system can also be utilized to guide mobile objects to their intended destinations.

In order to realize such a guidance system, information must be obtained from each of the objects to be transported to different locations (address of merchandise to be shipped, size and shape of an installation part, etc.), with this information being linked with the desired transporting goal. For this purpose, the mobile objects are equipped with response units in which information identifying the desired destinations of the respective objects can be stored. An interrogation unit is stationed at at least one location on the transporting path to read out the information from the response unit of each object passing by and to transmit this information to a central computer which then takes over the control of the transportation path.

Figure 1:
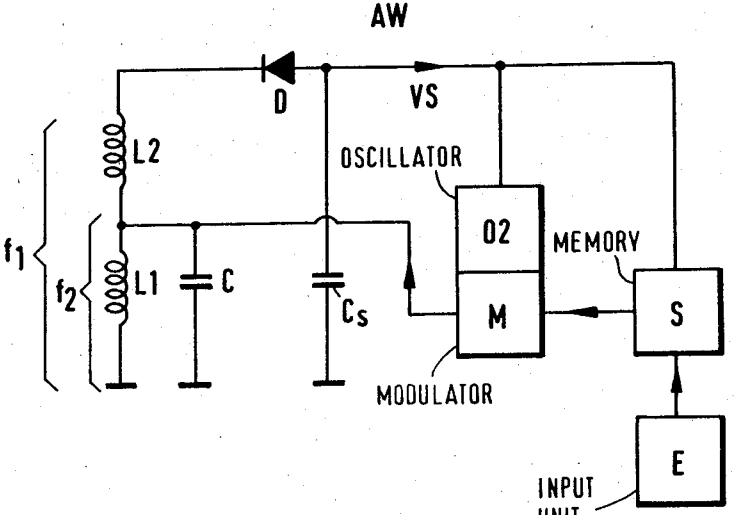
FIG. 1 is a basic circuit diagram for the interrogation unit and for the response unit of an embodiment of the invention.
Figure 1:
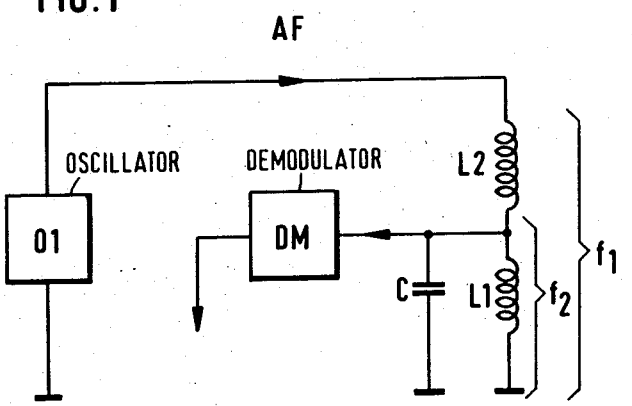

The basic structure of an interrogation unit AF and of a response unit AW can be seen in FIG. 1. The input of the response unit AW includes two resonant circuits of which the first resonant circuit is composed of an inductance L1 and a capacitance C connected in parallel therewith, and the second resonant circuit includes the inductance L1, the capacitance C connected in parallel therewith and a further series-connected inductance L2. According to the present invention, these two inductances are formed by a single induction coil which is provided with a tap.

The complete induction coil serves as a receiving antenna for a carrier signal at frequency $f_1$ generated and emitted by an oscillator 01 of interrogation unit AF. The second resonant circuit composed of inductances L1, L2 and capacitance C is tuned to this frequency $f_1$, This second resonant circuit is connected to a rectifier D which rectifies the received carrier signal at frequency $f_1$ and supplies the energy thereof to a storage capacitor $C_s$ which then provides a direct supply voltage VS for the electronic components of the response unit. If now, during travel past interrogation unit AF, response unit AW receives a carrier signal at frequency $f_1$, the information specific to unit AW and stored in a memory S is modulated with the aid of a modulator M onto a carrier signal at frequency $f_2$ which is produced by an oscillator 02.

The first resonant circuit, which is tuned precisely to this frequency $f_2$, emits the information signal to interrogation unit AF.

Interrogation unit AF has the same resonant circuits tuned to the same frequencies $f_1$ and $f_2$ as response unit AW. Suitably, interrogation unit AF is also equipped with only a single induction coil which is part of the first resonant circuit as well as part of the second resonant circuit. The information signal received from the interrogation unit via the induction coil reaches a demodulator DM at whose output the information from memory S of the response unit can be obtained. The detected information is finally transmitted to a central computer which can then direct the associated mobile object to its intended destination.

It has been found to be very advantageous to provide response unit AW with only a single induction coil to serve as antenna for receiving the energy signal and for transmitting the information signal. As can be seen clearly in FIG. 2, this results in a very compact and easily handled configuration for response unit AW. The electronic circuit components of the response unit are here accommodated in a block-shaped, flat housing around whose narrow sides is wound the induction coil IS. A concave recess in the narrow sides of the housing provides secure support for the induction coil.

A switch or key field TF is disposed at the frontal face of the housing to serve as an input unit for the memory. This input unit is block E in FIG. 1. If a response unit AW is attached to a mobile object, the actual information relating to the responsive object can always be fed manually into the memory via the switch or key filed TF.

Figures 3, 4, 5, 6:
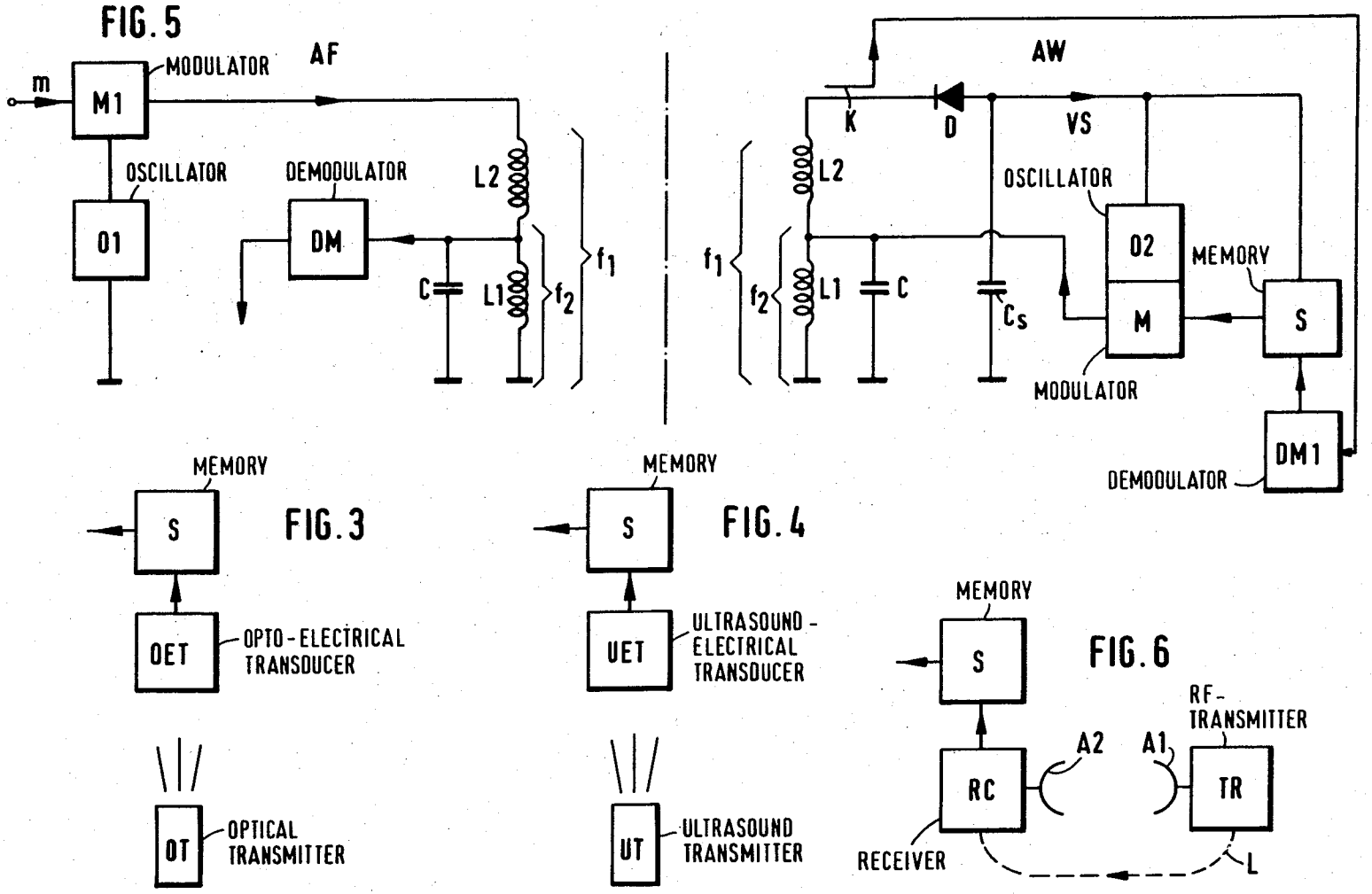
FIG. 3 is a block diagram of a circuit to write information into the memory by means of an optical transmitter.
FIG. 4 is a block diagram of a circuit to write information into the memory by means of an ultrasound transmitter.
FIG. 5 is a block circuit diagram of another embodiment of the invention wherein the response unit receives information for its memory from the interrogation unit.
FIG. 6 is a block diagram of a circuit to write information into the memory by means of an RF-transmitter.

Alternatively, the information may be written into the memory from a remote location by means of an optical or ultrasound transmitter. Instead of the key field TF, the housing would then have to be equipped with an optical or ultrasound receiving element. FIG. 3 shows the memory S connected to an opto-electrical transducer (e.g. photo diode) OET and an optical transmitter (e.g. light emitting diode) OT which radiates from a remote location an optical signal modulated with the information for the memory. FIG. 4 shows the memory S connected to an ultrasound-electrical transducer UET and an ultrasound transmitter UT which radiates from a remote location an ultrasound signal modulated with the information for the memory.

As shown in FIG. 5, the information to be written into the memory can also be transmitted to response unit AW from interrogation unit AF in that this information is modulated onto the carrier signal by a modulator M1 in the interrogation unit.

In the response unit AW a part of the received modulated carrier signal is coupled out by a coupler K which is arranged between the inductance L2 and the rectifier D. This part of the modulated carrier signal is lead to a demodulator DM1 which is connected to the memory device S.

As shown in FIG. 6, the information to be written into the memory S can also be transmitted from A RF-transmitter TR in that this information is modulated onto a carrier signal. A receiver RC connected to the memory S receives the modulated carrier signal. The carrier signal can be transmitted over a conductor L connected with the receiver RC or wirelessly, for this matter the RF-transmitter has a transmitting antenna A1 and the receiver has a receiving antenna A2.

Figure 2:
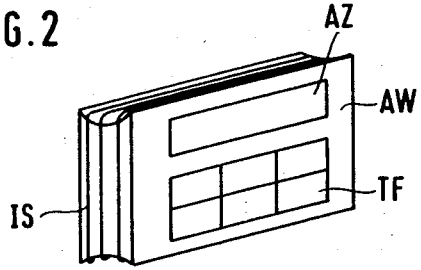
FIG. 2 is a simplified perspective view showing the outer configuration of a response unit according to the invention.
Figure 7:
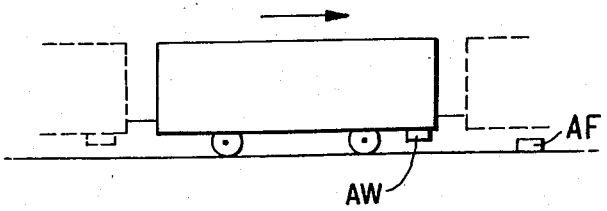
FIG. 7 is a block diagram illustrating utility of the interrogation and response units.

An optical display AZ at the frontal face of the housing shown in FIG. 2 provides information about the entire or partial contents of the memory.

Attachment elements, e.g. magnetic or adhesive strips, can be attached to the rear of the response unit housing so as to permit quick attachment of the response units to a mobile object (railroad car, freight container, etc.).

It will be understood that the above description of the present invention is susceptible to various modifications, changes and adaptations, and the same are intended to be comprehended within the meaning and range of equivalents fo the appended claims.

What is claimed is:

1. An automatic information transmission system for a mobile object comprising a response unit arranged to be carried along with the mobile object, and an interrogation unit arranged to be disposed alongside the path of movement of the mobile object for movement of said response unit past said interrogation unit, said interrogation unit comprising: means for emitting a carrier signal at a first frequency; and means for receiving a signal at a second frequency different from the first frequency, and said response unit comprising: electric circuit components including memory means for storing information relating to the mobile object, and signal generator means connected to said memory means for generating a signal at the second frequency and continaing the stored information; signal receiving means for receiving the carrier signal at the first frequency emitted by said emitting means of said interrogation unit; emitting means connected to said signal generator means for emitting the signal generated thereby; a transmitting-/receiving antenna consisting of a single induction coil and forming part of both said signal receiving means and said emitting means of said response unit, said signal receiving means of said response unit comprising a first resonant circuit tuned to the first frequency and including at least part of said coil, and said emitting means of said response unit comprising a second resonant circuit to the second frequency and including at least part of said coil; and energy conversion means connected between said signal receiving means of said response unit and said circuit components for deriving operating power for said circuit components from the carrier signal at the first frequency received by said signal receiving means of said response unit.

2. A system as defined in claim 1 wherein said coil is provided with a tap located between its ends and said response unit further comprises a capacitor connected to said tap and forming part of each said resonant circuit.

3. A system as defined in claim 1 wherein said response unit comprises: a housing having front and rear faces and accommodating said electric circuit components and said energy conversion means; a visible display device mounted on said housing front face for displaying the information stored in said memory means; input means mounted on said housing front face and connected for inputting information to said memory means; and attachment means mounted on said housing rear face for attaching said housing to a mobile object, and wherein said induction coil is wound around said housing.

4. A system as defined in claim 3 wherein said input means comprises an array of keys.

5. A system as defined in claim 3 wherein said input means comprises an array of switches.

6. A system as defined in claim 3 wherin said input means comprises a radiant energy receiving element for receiving information to be stored in said memory means from a remote radiant energy transmitter.

7. A system as defined in claim 6 wherein the radiant energy is in the form of light.

8. A system as defined in claim 6 wherein the radiant ernergy is in the form of ultrasonic energy.

9. A system as defined in claim 1 further comprising a transmitting unit external to said response unit for transmitting a carrier signal modulated with information to be stored in said memory means, and wherein said response unit comprises information signal receiving means connected to said memory means for receiving the modulated signal transmitted by said transmitting unit and for storing the information modulating that signal in said memory means.

10. A system as defined in claim 9 wherein said transmitting unit transmits the modulated carrier signal in a wireless manner.

11. A system as defined in claim 9 further comprising a conductor connected between said transmitting unit and said information signal receiving means for conducting the signal transmitted by said transmitting unit to said information signal receiving means.

12. A system as defined in claim 1 wherein said carrier signal emitting means of said interrogation unit emits the carrier signal modulated with information to be written into said memory means.

13. In a process for routing railroad cars, the improvement comprising: using the system of claim 1 by disposing the response unit in a railroad car, disposing the interrogation unit along side a track via which the railroad car travels, and transmitting routing information from the response unit to the interrogation unit when the response unit is interrogated by the interrogation unit.

14. In a process for routing freight containers, the improvement comprising: using the system of claim 1 by disposing the response unit in a freight container, disposing the interrogation unit along a path of the freight container, and transmitting routing information from the response unit to the interrogation unit when the response unit is interrogated by the interrogation unit.

15. In a process for controlling the conveyance of an object to a selected destination, the improvement comprising: using the system of claim 1 by attaching the response unit to an object being conveyed, disposing the interrogation unit along a path about which the object is being conveyed, and transmitting information useful for controlling the conveyance of the object from the response unit to the interrogation unit when the response unit is interrogated by the interrogation unit.

* * * * *